US006053789A

United States Patent [19]

Miyashiro

[11] Patent Number: 6,053,789

[45] Date of Patent: Apr. 25, 2000

[54] SURFBOARD FIN PIVOTAL MECHANISM

[76] Inventor: Lawrence Miyashiro, 18 Hialoa St., apt. 5, Honolulu, Hi. 96817

[21] Appl. No.: 09/321,945

[22] Filed: May 28, 1999

[51] Int. Cl.[7] ..... B63B 1/00

[52] U.S. Cl. ..... 441/79; 114/140

[58] Field of Search ..... 441/74, 79; 114/39.12, 114/140, 132

[56] References Cited

U.S. PATENT DOCUMENTS

| | | | |
|---|---|---|---|
| 3,890,661 | 6/1975 | Johnson | 441/79 |
| 4,733,496 | 3/1988 | Wallner . | |
| 4,811,674 | 3/1989 | Stewart | 441/79 |
| 4,854,904 | 8/1989 | Wahl | 441/79 |
| 5,306,188 | 4/1994 | Skedeleski et al. . | |
| 5,480,331 | 1/1996 | Lewis . | |
| 5,649,846 | 7/1997 | Harper et al. . | |
| 5,664,979 | 9/1997 | Benham . | |

*Primary Examiner*—Ed Swinehart
*Attorney, Agent, or Firm*—Michael I. Kroll

[57] ABSTRACT

The present invention discloses a limited pivotal fin system 12 for a surfboard 10. The fins self-pivot as the surfboard is turned by the body weight of the user. The pivotal fin system includes an upper stationary mounting portion 18 attached directly to the underside of the surfboard 10, and a lower pivoting fin 12 with a limited rotational pivoting mechanism 16 located in an upper recessed area 28 on the leading edge 26 of the pivoting fin 12. The lower pivoting fin 12 is fixedly mounted to the upper stationary mounting portion 18. The pivoting mechanism 16 comprises an upper 20 and lower plate 32 which are rotably connected 52 to each other and includes a cavity 34 in the upper plate 20 where pins 24 from the lower plate 32 are projected to prevent movement beyond a few degrees. An alternative embodiment discloses a different form of limited pivoting mechanism 54 when the mechanism is mounted directly into the surfboard 10.

7 Claims, 10 Drawing Sheets

SURFBOARD FIN PIVOTAL MECHANISM

BACKGROUND OF THE INVENTION

1. Field of the Invention

The present invention relates generally to surfboards and, more particularly, to a mechanism which will provide for limited pivotal movement of a surfboard fin to enhance forward drive, directional guidance, and reduced water resistance during turns.

2. Description of the Prior Art

There are numerous designs for pivotal fin movement on watercraft. Typical of these patents is U.S. Pat. No. 5,306,188 issued to Skedelski et al on Apr. 26, 1994.

Another patent was issued to Wallner on Mar. 29, 1988 as U.S. Pat. No. 4,733,496. Yet another U. S. Pat. No. 5,664,979 was issued to Benham on Sep. 9, 1997. Still another was issued to Harper et al on Jul. 22, 1997 as U.S. Pat. No. 5,649,846. And yet another was issued to Lewis on Jan. 2, 1996 as U.S. Pat. No. 5,480,331.

U.S. Pat. No. 5,306,188

Inventors: David Skedeleski

Eric Arakawa

Issued: Apr. 26, 1994

A surfboard fin intermediate having a rigid body element with flexible material (e.g. rubber) covering the leading and trailing edges, with a protective material—such as aluminum foil tape—readily removably secured to the flexible material on a small part of the body element to substantially completely cover the flexible material to protect it during manufacture of a surfboard with the fin attached, such as during sanding. The fin with protective material is placed so that the base engages the bottom of a surfboard, resin impregnated fiberglass rope or roving is applied to the base of the fin and the surfboard bottom spaced from the flexible material, and then resin impregnated fiberglass cloth is applied to the fin and bottom surface of the surfboard. After the resin dries, most of the fiberglass cloth exterior of the fin is cut away with a blade, and then any unwanted portions of the fiberglass cloth associated with the fin are sanded away. Then the protective material is removed from the fin, e.g. by stripping the tape off.

U.S. Pat. No. 4,733,496

Inventor: Peter Wallner

Issued: Mar. 29, 1988

A novel fin for surfboards and watercraft that includes a pivoting rudder-like section that swings out when a turn is commenced, enhancing the maneuverability of the surfboard by reducing the resistance of the fin as it moves sidewards through the water in a turn and by redirecting the water flow through the pivoting rudder section in the direction of the turn. A fixed blade attaches to the surfboard and a separate pivoting fin section is joined to the fixed blade by two pivot pins. Protruding from a vertical hole in the top of the pivoting fin section is a spring loaded pin which presses into the underside of a foil integrated into the underside of the fixed blade mounting section. The channel is deepest in the center of the foil thus the spring loaded pin is traveling back and forth along the channel seeks the deepest portion which tends to align the two fin blade sections. A threaded rod locates in the hole below the spring loaded pin and an externally accessible thumbwheel when rotated moves the threaded rod up or down allowing more or less vertical travel of the spring loaded pin thus enabling adjustment of the movement of the pivoting blade section.

U.S. Pat. No. 5,664,979

Inventor: Roger A. Benham

Issued: Sep. 9, 1997

A watercraft hull having a lower surface for normal contact with a body of water includes a fin having an inner end secured to the lower surface for extending into a body of water, a hinge intermediate the inner and outer ends for enabling an outer portion of the fin to pivot about the longitudinal axis of the watercraft for enabling increased controllability and performance of the watercraft.

U.S. Pat. No. 5,649,846

Inventor: Harper et al

Issued: Jul. 22, 1997

A pivotable fin system, for use with an aquafoil such as a surfboard, comprising a plug and a fin having a main portion and a tab. The plug mounts in the surfboard, and has a center slot for receiving the tab. The tab has a reverse taper that matches a reverse taper in the central slot. The tab has at least one vertical slot which compresses to allow the tab to be mounted in the central slot, the vertical slot expanding once the tab is fully inserted into the central slot, the tab then securely held in place by the matching reverse tapers of central slot and tab. The tab has at least one tab cut for allowing the main portion of the fin to pivot with respect to the tab, allowing the main portion of the fin to self-align to a position where it reduces drag and cavitation.

U.S. Pat. No. 5,480,331

Inventor: Tommy R. Lewis

Issued: Jan. 2, 1996

A flexible fin for surfboards, sailboards and other watercraft comprises a thin core sheet made of laminated fiberglass sandwiched between two slabs of closed-cell polyurethane foam. The flexible fin provides for sharper turns while increasing the buoyancy of the craft.

While these pivotal fins may be suitable for the purposes for which they were designed, they would not be as suitable for the purposes of the present invention, as hereinafter described.

SUMMARY OF THE PRESENT INVENTION

The present invention discloses a limited pivotal fin system for a surfboard. The fins self-pivot as the surfboard is turned by the body weight of the user. The pivotal fin system includes an upper stationary fin mounting portion attached directly to the underside of the surfboard, and a lower pivoting fin with a limited rotational pivoting mechanism located in an upper recessed area on the leading edge of the pivoting fin. The lower pivoting fin is fixedly mounted to the upper stationary fin mounting portion. The pivoting mechanism comprises an upper and lower plate which are rotably connected to each other and includes a cavity in the upper plate where pins from the lower plate are projected to prevent movement beyond a few degrees. An alternative embodiment discloses a different form of limited pivoting mechanism when the mechanism is mounted directly into the surfboard.

A primary object of the present invention is to provide pivotal surfboard fin movement which will provide for a limit to the extent of the fin pivot to retain forward drive.

Another object of the present invention is to provide pivotal surfboard fin movement which will enhance maneuverability, balance, and responsiveness of surfboards.

Yet another object of the present invention is to provide interchangeable pivotal surfboard fins which will enhance the creativity of the surfing community.

Additional objects of the present invention will appear as the description proceeds.

The present invention overcomes the shortcomings of the prior art by providing a means for interchanging surfboard fins as well as providing an apparatus which can be installed in new boards or retrofitted to existing boards which provides limited pivotal surfboard fin movement.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawing in which.

DESCRIPTION OF THE PREFERRED EMBODIMENT(S)

Figure 1:
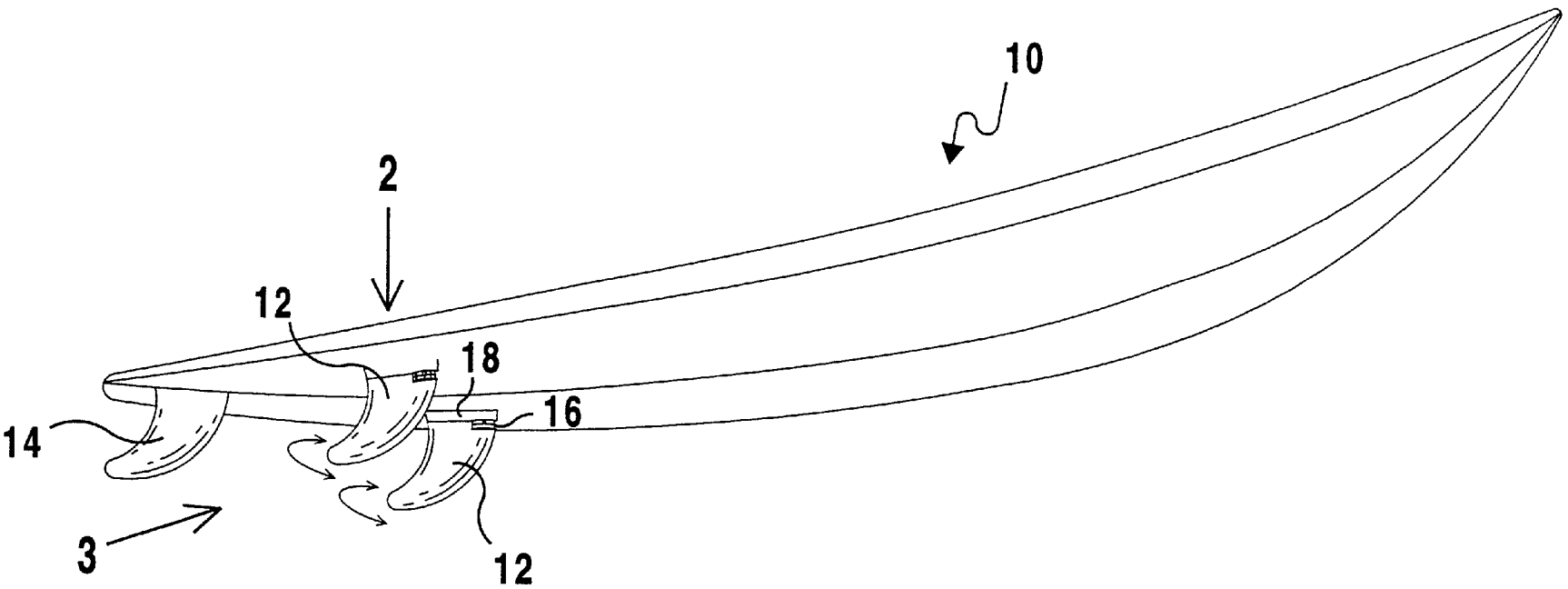
FIG. 1 is a perspective view of one application of the present invention wherein two of three fins on a surfboard have the preferred embodiment of the present invention installed therein.

Turning now descriptively to the drawings, in which similar reference characters denote similar elements throughout the several views, FIGS. 1 through 13 illustrate the present invention being a device 12 for providing a pivoting fin to surfboards 10, and other watercraft. With regard to the reference numerals used, the following numbering is used throughout the various drawings.

10 surfboard
12 pivotal fins
14 non-pivotal fins
16 rotational mechanism
18 fin mounting portion
20 upper plate
22 upper plate mount
24 lower plate pin
26 front edge of fin
28 recess in fin
30 hole in upper stem
32 lower member
34 cavity of upper member
36 face of cavity
38 upper mounting stem
40 lower mounting stem
42 set screw
44 hole for upper stem
46 hole for lower stem
47 center shaft
48 set screw hole

49 flange
50 spacer
51 screw for rotatable means
52 rotatable connection of lower member
53 threaded end
54 limited pivotal mechanism
55 cavity
56 winged stop
58 mounting post
60 washer
62 set screw
64 set screw hole
66 center post of alternate embodiment
67 cavity
68 stops of alternate embodiment
69 mounting shaft
70 limited rotation mechanism Turning to FIG. 1, therein is shown a perspective view of one application of the present invention 12 wherein two of three fins on the rear end of a surfboard 10 have the preferred embodiment of the present invention 12 installed therein. Therein is shown a surfboard 10 along with the pivotal fins of the present invention 12 and a non-pivotal standard fin 14. Surfboard fins generally are in a single or tri-fin configuration as shown in FIG. 1 to provide directionality and turning capability. The fins are mounted on the underside of the surfboard and generally are non-pivotal. Although non-pivotal fins provide maneuverability, current non-pivotal fins restrict surfboard performance. The pivotal fin systems of the present invention are a new concept that improve fin function. The fins self pivot as the surfboard initially turns by body weight distribution. The limited pivoting action of the fins serve to provide directionality. The fins of the present invention pivot at an angle of approximately 15 to 30 degrees. The pivotal action enhances turning capability by decreasing water resistance on the fins. The pivotal action also helps guide the surfboard through turns.

Also shown in FIG. 1, is the limited rotational mechanism or pivoting point 16 of the present invention. Also shown is the stationary fin mounting portion 18 which is non-pivoting and fixedly attached directly to the bottom of the surfboard 10.

Figure 2:
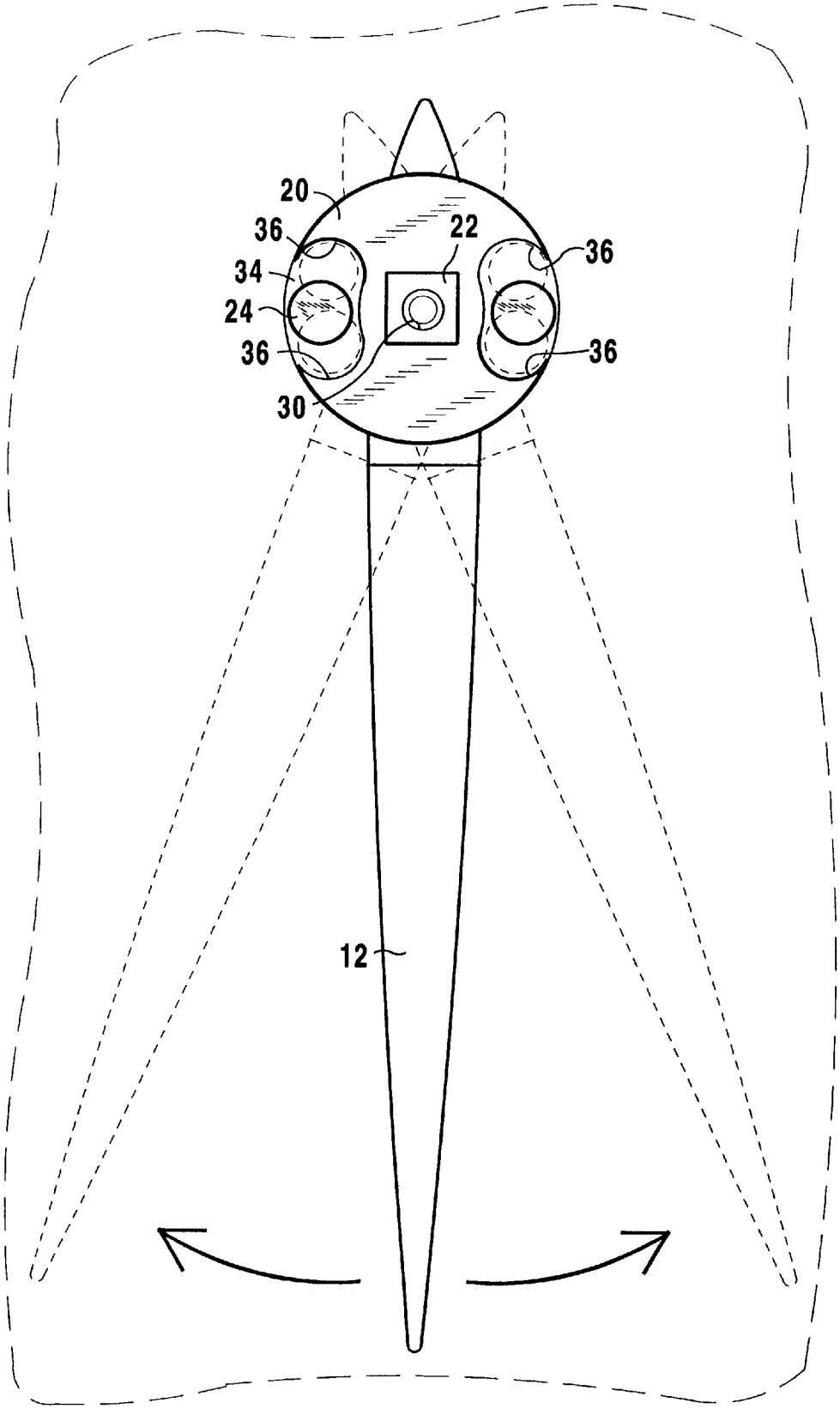
FIG. 2 is a top view of one of the fins, taken from FIG. 1 as indicated, showing the preferred embodiment of the present invention installed in a fin. Also shown in outline is the degree of movement of the modified fin.

Turning to FIG. 2, therein is shown a top view of one of the fins, taken from FIG. 1 as indicated, showing the preferred embodiment of the present invention 12 installed in a fin. Shown in outline is the degree of movement of the modified fin which is about 20 to 25 degrees. Therein is shown the pivotal fin 12 along with the upper plate 20 of the pivoting mechanism, the upper mounting stem or member 38 of the pivoting mechanism, along with the pin 24 of the lower member of the pivoting mechanism which extends into the cavity 34 of the upper plate and is prevented from travelling a greater distance than allows the fin to pivot about 25 degrees due to the pins 24 contacting the faces 36 of the cavity or slots.

Figure 3:
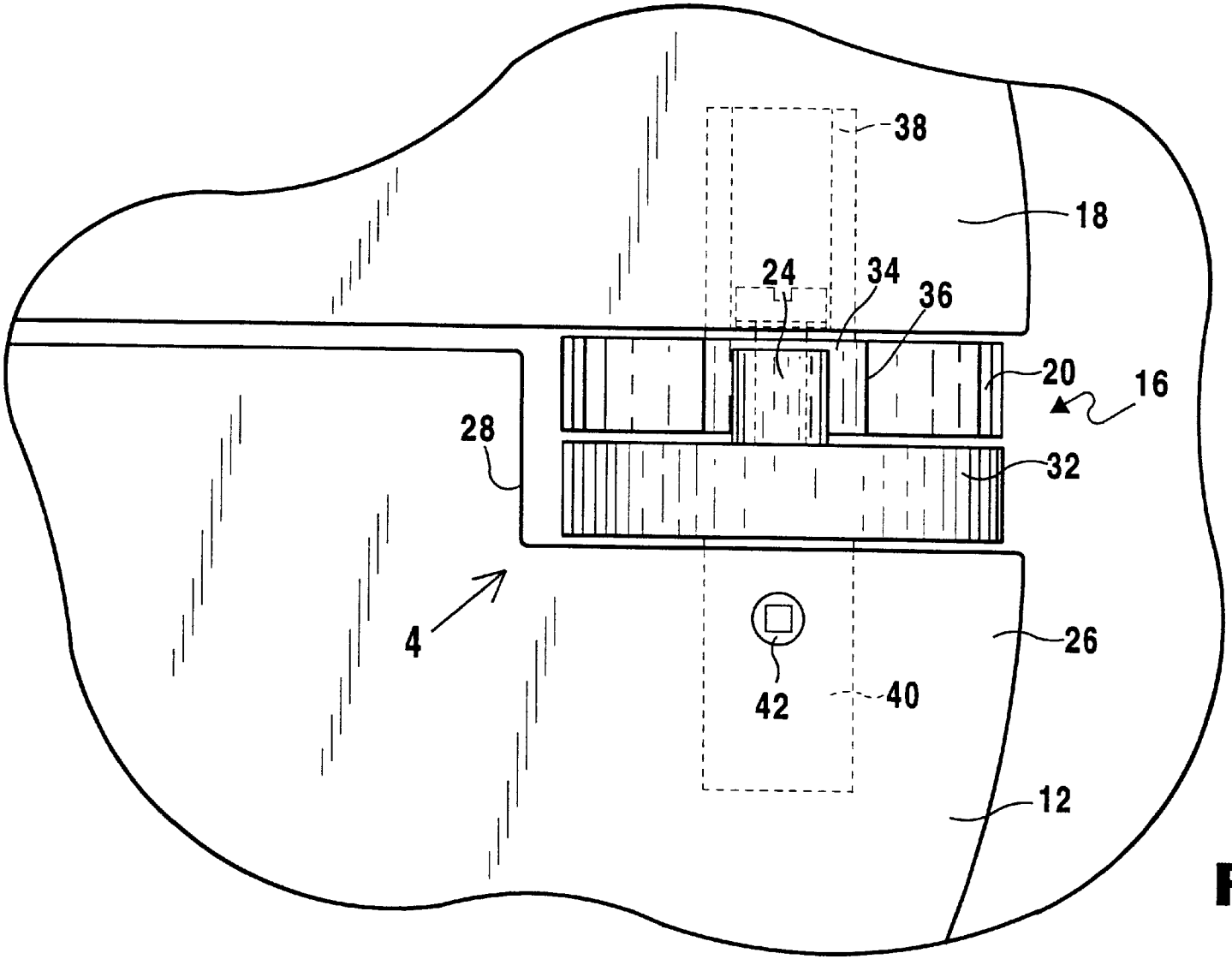
FIG. 3 is an enlarged view, taken from FIG. 1 as indicated, showing the preferred embodiment of the present invention installed in a surfboard fin wherein the pin of the lower member residing in a cavity of the upper member will provide limited pivotal movement.

Turning to FIG. 3, therein is shown an enlarged view, taken from FIG. 1 as indicated, showing the preferred embodiment of the present invention 12 installed on a surfboard fin wherein the pin 24 of the lower plate member 32 resides in a cavity 34 of the upper member 20 will provide limited pivotal movement. Also shown is the fin 12, its leading edge 26 having a recess 28 cut in the fin to allow accommodation of the pivoting mechanism generally shown at 16.

Also shown is the stationary fin mounting portion 18. The pivoting mechanism 16 is generally comprised of an upper member 20 and a lower member 32. Note that the upper member 20 has a cavity or slot 34 therein within which the pin 24 of the lower member 32 operates and travels. The upper cavity 34 has a front and rear surface 36 which prevents the pin 24 and thereby prevents the fin 12 from moving a great angular distance thereby assuring limited pivoting of the fin 12. The faces 36 function as stops for the pin to prevent great travel distance. This illustrates the mechanism which allows the self-pivoting action of the pivoting fins 12 of the present invention and further the limited pivoting action of the fins 12. Also shown is the upper mounting stem or member 38 of the upper member 20 and the mounting stem 40 of the lower member 32. Also shown is the hex head set screw 42 of the lower mounting stem 40.

Figure 4:
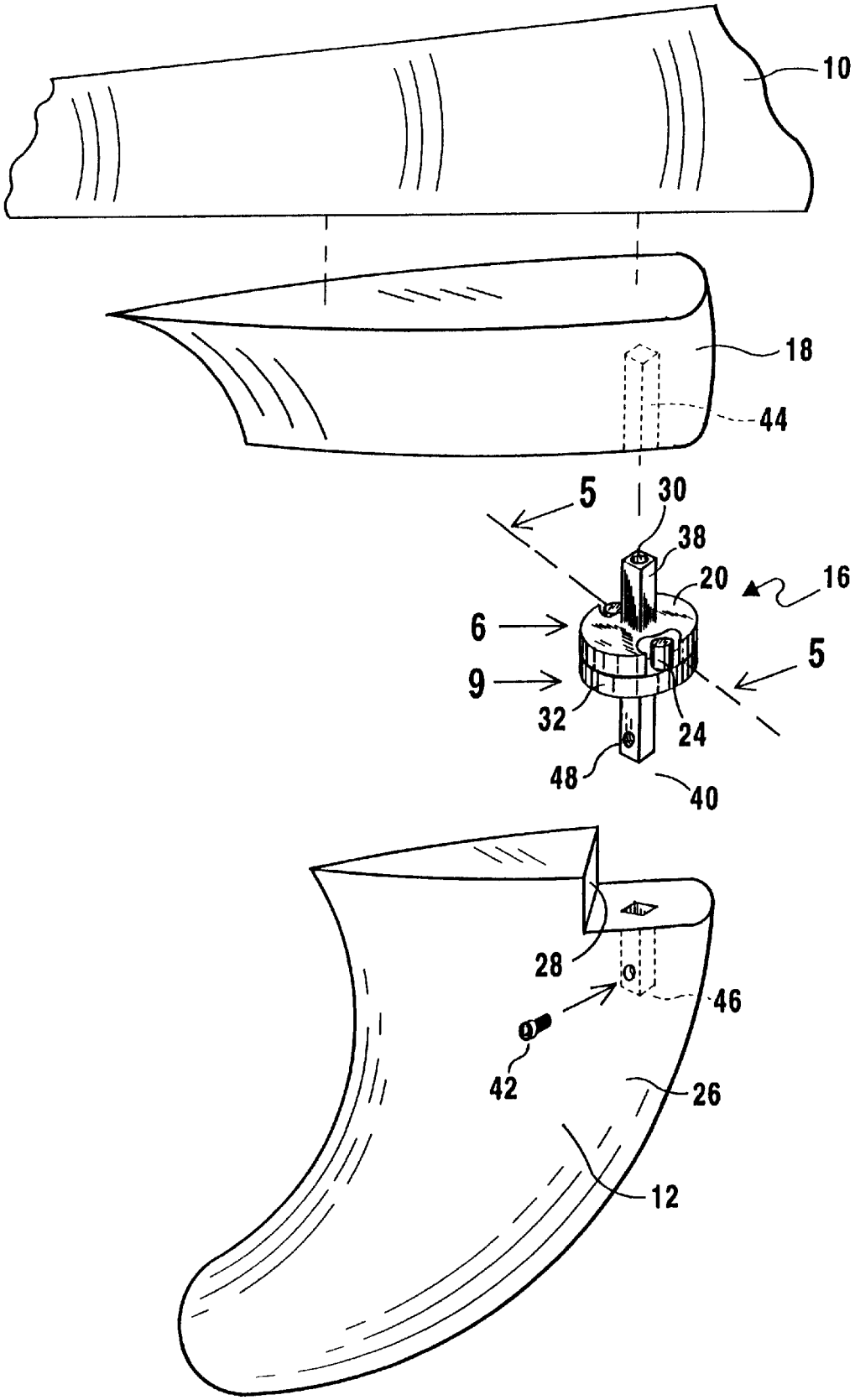
FIG. 4 is a side perspective exploded view of the preferred embodiment of the present invention, taken from FIG. 3 as indicated, showing a mechanism which is installed between the two members of the surfboard fin. The apparatus shown forms a limited rotational coupling thereby providing the lower fin member with a pivotal movement. Also shown is a hex head set screw which will provide means for substituting various fin types and forms to the surfboard.

Turning to FIG. 4, therein is shown a side perspective exploded view of the preferred embodiment of the present invention 12, taken from FIG. 3 as indicated, showing a mechanism 16 which is installed between the two upper and lower members of the surfboard fin. The apparatus 16 shown forms a limited rotational coupling thereby providing the lower fin member 12 with a pivotal movement.

Also shown is a hex head set screw 42 which will provide means for substituting various fin types and forms to the surfboard 10. Shown is the surfboard 10, the stationary fin mounting portion 18, the pivoting fin 12, the leading edge 26 of the pivoting fin, along with the limited rotational coupling or pivoting mechanism 16. Also shown is the recessed portion 28 of the leading edge of the pivoting fin wherein the limited rotation coupling 16 generally resides and fits. The upper plate 20 of the limited rotational coupling 16 is shown along with upper mounting stem or shaft 38 having a hole 30 therein through which a connecting means to the lower plate 32 is provided along with the square shaped mounting hole or cavity 44 for fixedly mounting stem 38 of the upper plate 20. The upper plat 20 and the lower plate 32 may also be machined As a single limited rotational coupling unit.

Also shown along with the square-shaped hole 44 shown in the upper stationary portion of the fin is the square-shaped hole 46 for the mounting shaft, stem or member 40 of the lower mounting fin. Also shown is the lower plate 32 of the pivoting mechanism 16 along with the pin 24 of the pivoting mechanism. Also shown is the set screw 42 along with the female hole for the set screw 48 in the stem 40. Note that the set screw allows for the easy removal of the pivoting fins 12 from the rotational coupling 16 so that various styles, shapes and designs of pivoting fins 12 can be installed onto the pivoting mechanism 16.

Figure 5:
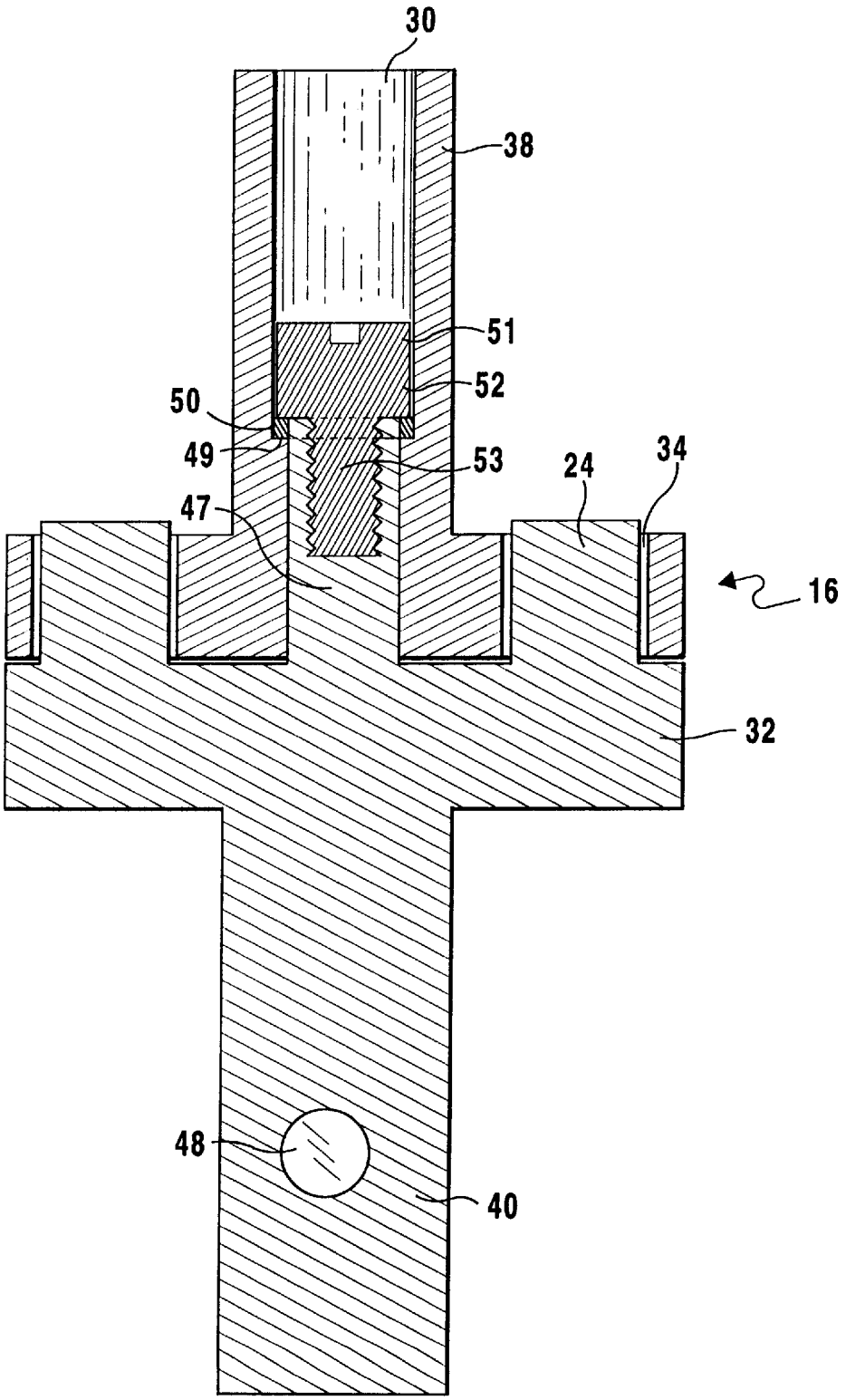
FIG. 5 is a cross sectional view of the limited rotational coupling wherein the lower member provides means for attachment of various fin types.

Turning to FIG. 5, therein is shown a cross sectional view of the limited rotational coupling 16 wherein the lower member 32 provides means for attachment of various fin types. Therein is shown the upper mounting stem 38, the lower mounting stem 40 having a set screw hole 48 therein. Also shown is the pin 24 of the lower plate along with the cavity in the upper plate 34. Also note that the lower plate 32 has rotatable connection means to the upper plate at 52 at its center stem 47. The rotatable connection means 52 is accomplished by the center stem member end 52 being threaded 53 and having a nut 51 attached thereto further having a spacer or washer 50 in communication with a flange 49 inside the hole 30 in the upper stem 38.

Figure 6:
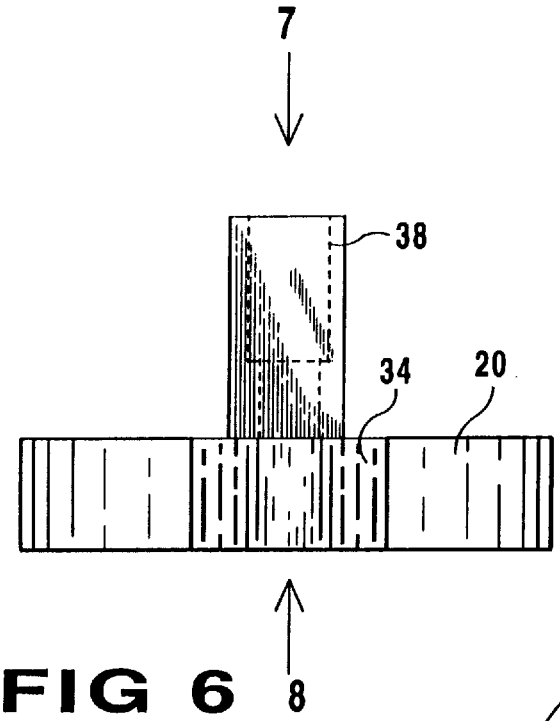
FIG. 6 is a front elevation view, taken from FIG. 4 as indicated, of the upper member of the pivotal fin coupling of the preferred embodiment of the present invention.

Turning to FIG. 6, therein is shown a front elevation view, taken from FIG. 4 as indicated, of the upper member 38 of the pivotal fin coupling of the preferred embodiment of the present invention. Therein is shown the upper plate 20 along with its mounting stem 38. Also shown is the cavity or slot 34.

Figure 7:
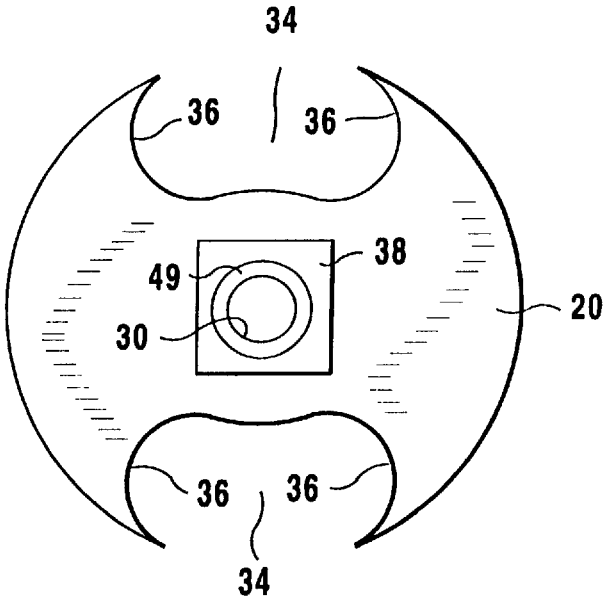
FIG. 7 is a top plan view, taken from FIG. 6 as indicated, of the upper member of the pivotal fin coupling of the preferred embodiment of the present invention.

Turning to FIG. 7, therein is shown a top plan view, taken from FIG. 6 as indicated, of the upper member 20 of the pivotal fin coupling of the preferred embodiment of the present invention. Shown therein is the upper plate 20 along with the mounting stem 38 showing the cavities 34. The front and rear faces of the cavity 36 are also shown.

Figure 8:
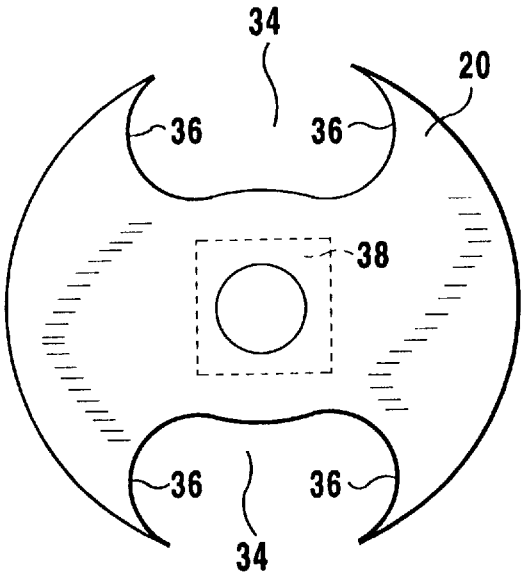
FIG. 8 is a bottom plan view, taken from FIG. 6 as indicated, of the upper member of the pivotal fin coupling of the preferred embodiment of the present invention.

Turning to FIG. 8, shown therein is a bottom plan view, taken from FIG. 6 as indicated, of the upper member 20 of the pivotal fin coupling of the preferred embodiment of the present invention. Shown therein is the upper plate 20 along with the mounting pin 38 showing the cavities 34. The front and rear faces of the cavity 36 are also shown.

Figure 9:
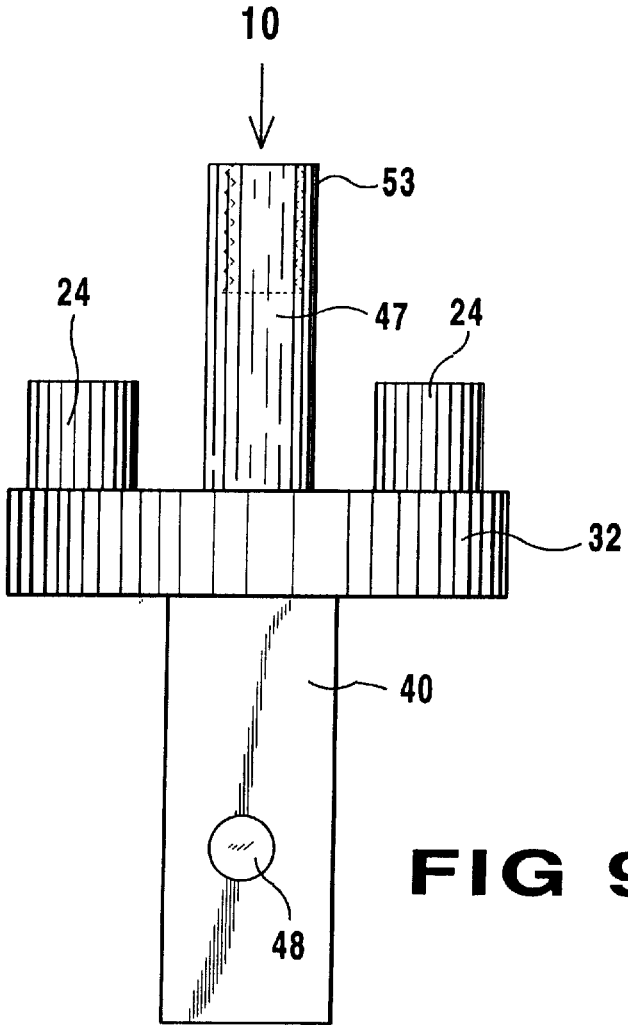
FIG. 9 is a front elevation view, taken from FIG. 4 as indicated, of the lower member of the pivotal fin coupling of the preferred embodiment of the present invention.

Turning to FIG. 9, therein is shown a front elevation view, taken from FIG. 4 as indicated, of the lower member 32 of the pivotal fin coupling of the preferred embodiment of the present invention. Therein is shown the lower plate 32 with its pins 24, its lower stem 40, and the lower female contact point or hole 48 for the set screw. Also shown therein is the center member 47 of the lower plate 32 along with the threaded end 53 of the upper plate 32.

Figure 10:
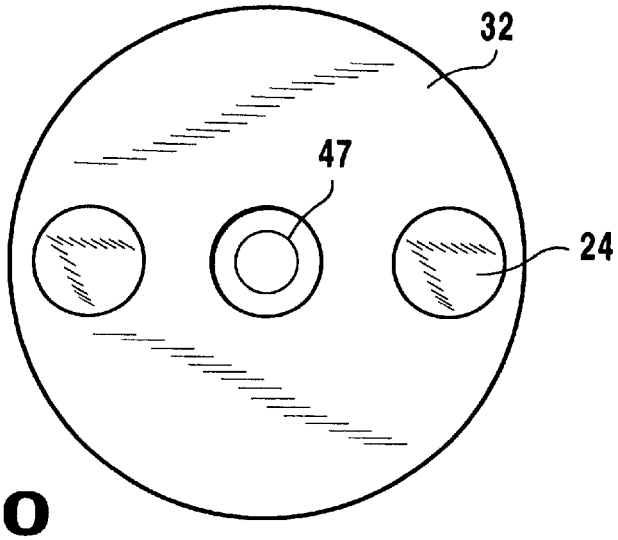
FIG. 10 is a top plan view, taken from FIG. 9 as indicated, of the lower member of the pivotal fin coupling of the preferred embodiment of the present invention.

Turning to FIG. 10, therein is shown a top plan view, taken from FIG. 9 as indicated, of the lower member 32 of the pivotal fin coupling of the preferred embodiment of the present invention. Therein is shown the lower member 32, the pins 24, and the center post member 47.

Figure 11:
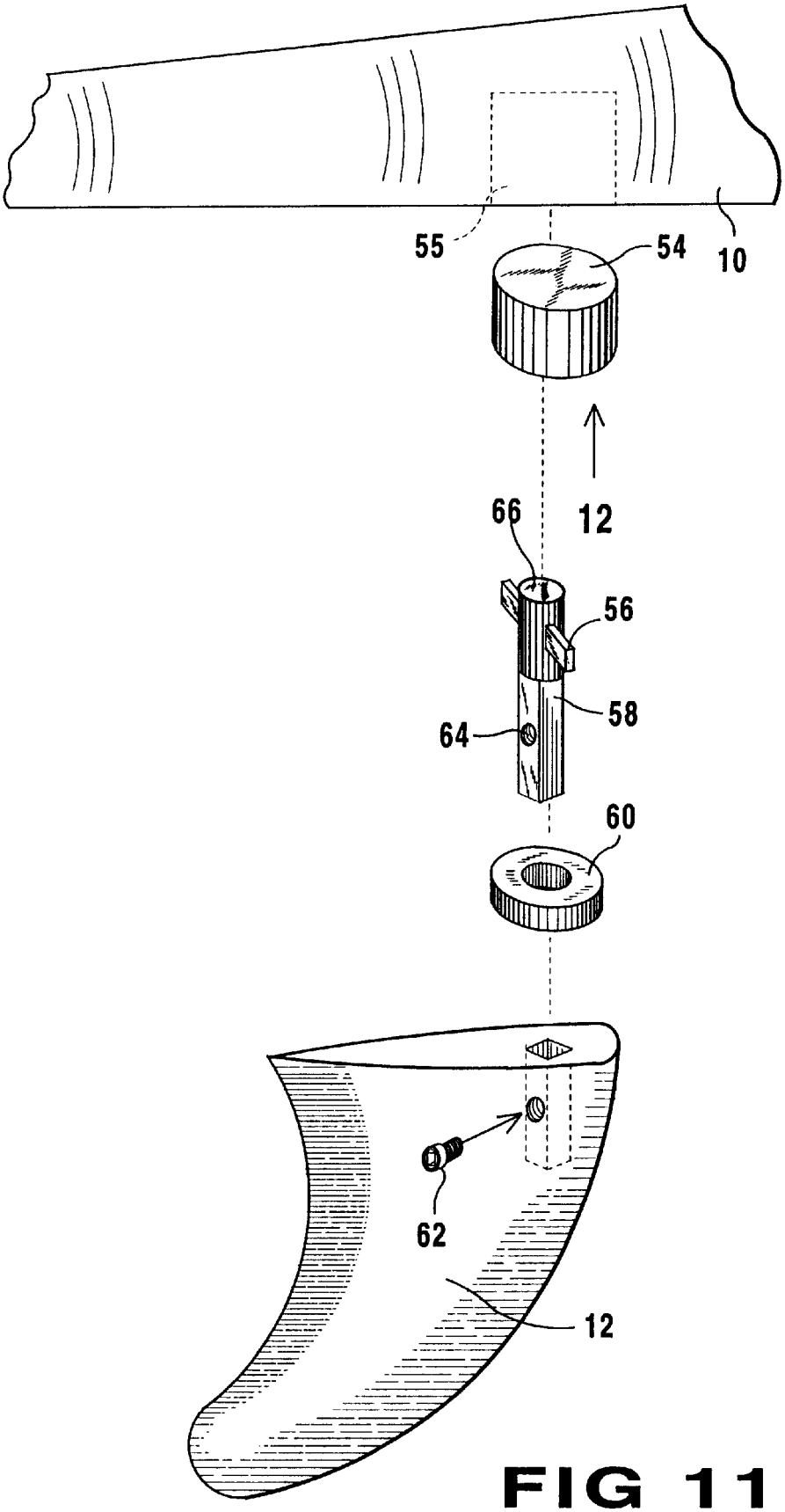
FIG. 11 is a side perspective exploded view of an alternate embodiment of the present invention, showing a mechanism which is installed directly into a cavity within the surfboard. The apparatus shown also forms a limited rotational coupling thereby providing the attached fin with limited pivotal movement. The apparatus can also be constructed as a single unit. Also shown is a hex head set screw which will provide means for substituting various fin types and forms to the surfboard.

Turning to FIG. 11, therein is shown a side perspective exploded view of an alternate embodiment of the present invention, showing a mechanism 54 which is installed directly into a cavity 55 within the surfboard 10. The apparatus shown also forms a limited rotational coupling thereby providing the attached fin 12 with limited pivotal movement. The apparatus can also be constructed as a single unit. Also shown is a hex head set screw 62 which will provide means for substituting various fin types and forms to the surfboard.

Therein is shown a surfboard 10, the pivotal fin 12, a mounting mechanism 54 mounted into the surfboard 10 which contains the pivoting mechanism along with an internal horizontally opposed winged contact mechanism or assembly 56 for providing limited rotation of the pivoting fin 12 along with its mounting stem 58 and a locking washer means 60 which holds the mechanism center post 66 to the pivotal mechanism 54 along with a set screw 62 and the set screw hole 64 within which the set screw 62 connects. Also shown is the center post 66 of the limited rotational mechanism.

Figure 12:
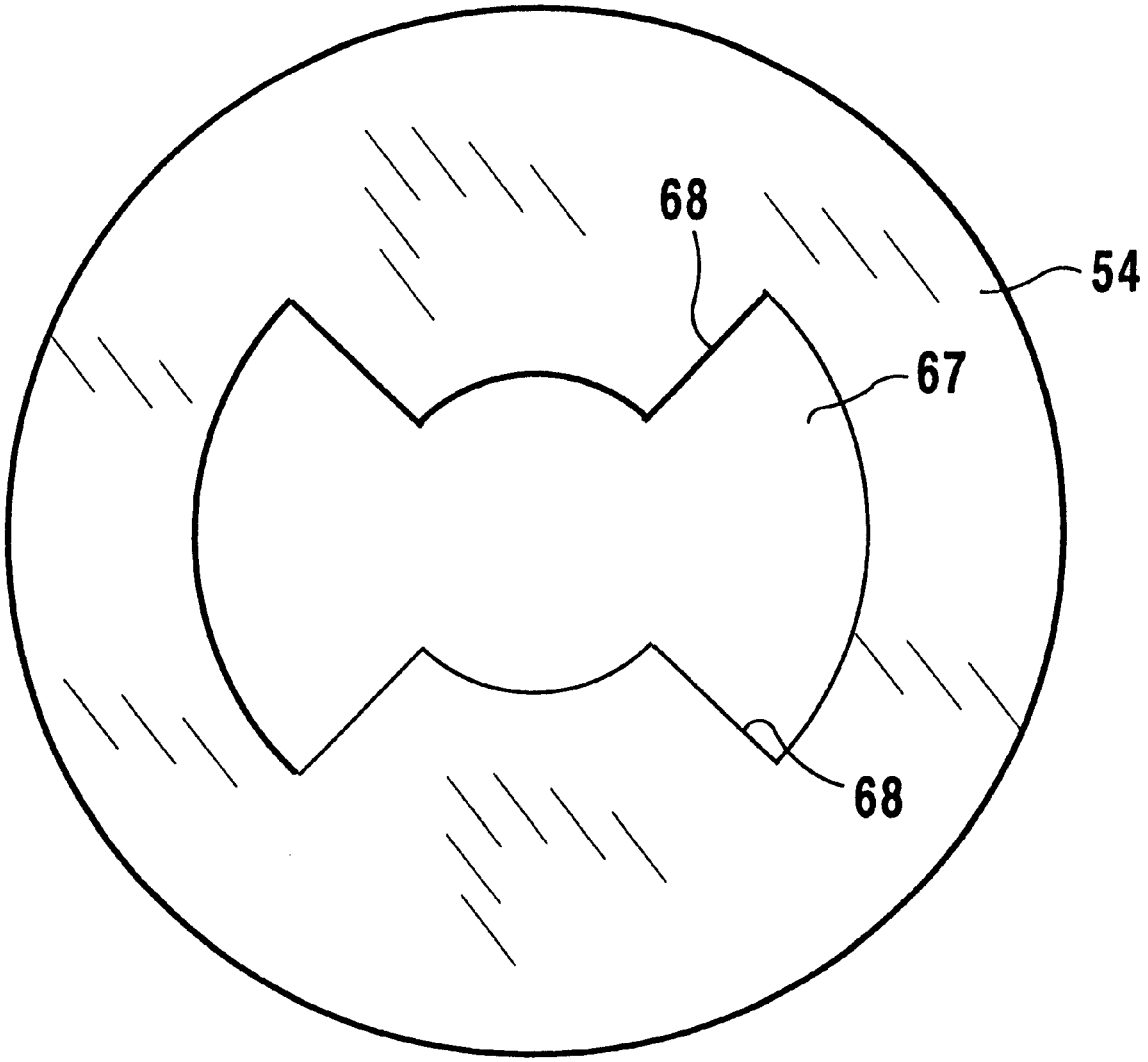
FIG. 12 is a bottom plan view of the upper member of the alternate embodiment of the present invention wherein the shaft will reside.

Turning to FIG. 12, therein is shown a bottom plan view of the upper member 54 of the alternate embodiment of the present invention wherein the shaft 66 will reside. Shown therein is the limited pivoting mechanism of the alternative embodiment 54 having a cavity 67 therein wherein the winged stop means 56 operates. The cavity has faces 68 with which the winged stop means 56 contact in order to provide limited pivoting of the fin 12 similar to the pivoting action previously described.

Figure 13:
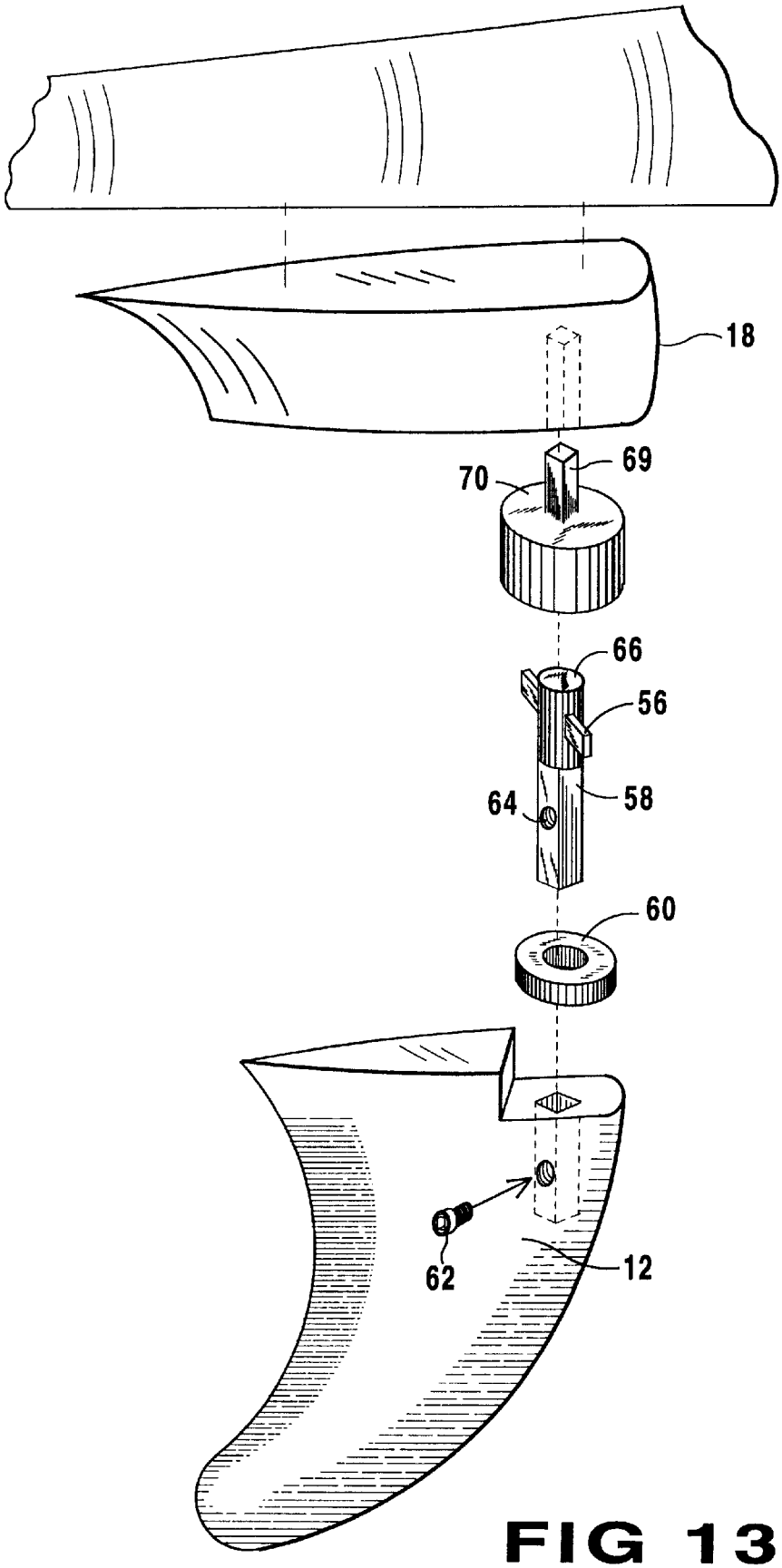
FIG. 13 is a side perspective exploded view of another alternate embodiment of the present invention, showing a mechanism which is installed between the two members of the surfboard fin. The apparatus shown forms a limited rotational coupling thereby providing the lower fin member with a pivotal movement. Also shown is a hex head set screw which will provide means for substituting various fin types and forms to the surfboard.

Turning to FIG. 13, therein is shown a side perspective exploded view of another alternate embodiment of the present invention similar to the embodiment shown in FIGS. 11 and 12, showing a mechanism 70 which is installed between the two upper 18 and lower 12 members of the surfboard fin. The apparatus shown forms a limited rotational coupling thereby providing the lower fin 12 member with a pivotal movement. Also shown is a hex head set screw which will provide means for substituting various fin types and forms to the surfboard.

Therein is shown a surfboard 10, the pivotal fin 12, a mounting mechanism 70 mounted through the shaft 69 onto the surfboard 10 through the stationary upper portion of the fin 18 which mechanism 70 contains the pivoting mechanism along with an internal winged contact mechanism 56 for providing limited rotation of the pivoting fin along with its mounting shaft 58 and a washer 60 along with a set screw 62 and the set screw hole 64 within which the set screw connects. Also shown is the center post 66 of the limited rotational mechanism.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A fin for connection to a surfboard or other watercraft, comprising:

a) an upper stationary portion;

b) said upper stationary portion fixedly mounted to an underside of the surfboard or other watercraft;

c) a lower pivoting fin;

d) said lower pivoting fin having a recessed portion on its upper leading edge;

e) a limited rotational mechanism;

f) said limited rotational mechanism being mounted in said recessed portion of said lower pivoting fin whereby said lower fin is allowed to pivot; and g) said limited rotational mechanism connecting said upper strationary portion to said lower pivoting fin whereby said lower pivoting fin is attached to said surfboard.

2. The apparatus of claim 1, further comprising said limited rotational mechanism having an upper plate, said plate having cavities including a face side therein, said limited rotational mechanism further comprising a lower plate, said lower plate having pins therein, said upper and lower plates being rotatably connected, said pins of said lower plate fitting into the cavities of said upper plate, said pins of said lower plate contacting said face side of said cavities of said upper plate whereby said face side of said cavities allow said pins and said lower plates limited rotation.

3. The apparatus of claim 1, wherein said upper plate further comprises a mounting shaft and said lower plate further comprises a mounting shaft, said mounting shaft of said upper plate being fixedly mounted in said stationary portion of said upper fin and said mounting shaft of said lower plate being removably mounted in said pivoting fin.

4. The apparatus of claim 1, wherein said pivotal fin pivots about 15 to 30 degrees.

5. A fin for connection to a surfboard or other watercraft, comprising:

a) an upper stationary portion;

b) said upper stationary portion fixedly mounted to an underside of the surfboard or other watercraft;

c) a lower pivoting fin;

d) said lower pivoting fin having a recessed portion on its upper leading edge;

e) a limited rotational mechanism;

f) said limited rotational mechanism being mounted in said recessed portion of said lower pivoting fin whereby said lower fin is allowed to pivot;

g) said limited rotational mechanism connecting said upper strationary portion to said lower pivoting fin whereby said lower pivoting fin is attached to said surfboard; and, h) said limited rotational mechanism having an upper mechanism housing, said housing having a cavity including a face side therein, said limited rotational mechanism further comprising a lower mechanism portion, said lower portion having a horizontally opposed winged assembly therein, said upper housing and lower portion being rotatably connected, said horizontally opposed winged assembly of said lower portion fitting into the cavity of said upper housing, said horizontally opposed winged assembly of said lower portion contacting said face side of said cavity of said upper housing whereby said face side of said cavity allows said horizontally opposed winged assembly and said lower portion limited rotation.

6. The apparatus of claim 5, said limited rotational mechanism further comprising a removable mounting shaft for mounting to said lower pivoting fin.

7. The apparatus of claim 5, wherein said pivotal fin pivots about 15 to 30 degrees.

* * * * *